US005398925A

United States Patent [19]

Zeltner

[11] Patent Number: 5,398,925

[45] Date of Patent: Mar. 21, 1995

[54] DEVICE FOR ACHIEVING A FLAT CONTACT OF STOCKS OR PRINTING MATERIALS

[75] Inventor: Jürgen Zeltner, Heidelberg, Germany

[73] Assignee: Heidelberger Druckmaschinen AG, Heidelberg, Germany

[21] Appl. No.: 70,547

[22] Filed: Jun. 1, 1993

[30] Foreign Application Priority Data

May 29, 1992 [DE] Germany ..... 42 17 813.4

[51] Int. Cl.[6] ..... B65H 5/00

[52] U.S. Cl. ..... 271/276; 271/195; 101/142

[58] Field of Search ..... 271/276, 314, 195, 194; 226/95; 101/142, 230–232, 409

[56] References Cited

U.S. PATENT DOCUMENTS 3,341,195 9/1967 Brandt et al. ..... 271/276
4,869,166 9/1989 Mathes .
5,086,698 2/1992 Wirz .
5,156,090 10/1992 Wirz .

FOREIGN PATENT DOCUMENTS 0306684 3/1989 European Pat. Off. .
104753 3/1974 Germany .
2754183 7/1978 Germany .
3920730 10/1991 Germany .
4039311 11/1992 Germany .

*Primary Examiner*—H. Grant Skaggs
*Attorney, Agent, or Firm*—Herbert L. Lerner; Laurence A. Greenberg

[57] ABSTRACT

Device for achieving a flat contact of stock on a curved surface of a cylinder for transporting the stock into a printing nip includes a plurality of blowing-air bars disposed in a region between an impression cylinder and a transfer drum and upstream of the printing nip in transport direction of the stock, the blowing-air bars being directed for blowing air in a direction opposing the transport direction of the stock, at least one of the plurality of blowing-air bars being stationary and, with the other of the plurality of blowing-air bars, respectively, having a plurality of air-blowing nozzle-shaped outlets disposed in a substantially arrow-shaped arrangement on the respective circumferences thereof, the arrangement of outlets including a central outlet disposed farthest upstream of the arrangement of outlets in the transport direction so as to be a first one of the outlets to act upon a sheet being transported in the transport direction.

8 Claims, 2 Drawing Sheets

DEVICE FOR ACHIEVING A FLAT CONTACT OF STOCKS OR PRINTING MATERIALS

SPECIFICATION

The invention relates to a device for achieving a flat or flush contact of stocks or printing materials, particularly on a curved surface of a cylinder by which the stock or printed material is conveyed into a printing nip.

A device of the foregoing general type on sheet-fed rotary offset printing presses has become known heretofore from the prior art (German Democratic Republic Patent 1 04 753). In a cylinder wedge or nip between a rubber-blanket cylinder and an impression cylinder, on the side of an exiting printed sheet, compressed air is blown between the rubber-blanket cylinder and the sheet in the region of the breakaway angle. The blown-in compressed air aids in the release or withdrawal of the printed sheet from the rubber-blanket cylinder.

The published European Patent Document 03 06 684 A2 discloses a device in multi-color rotary printing presses for pressing a sheet onto the impression cylinder. Blowing-air fingers having air-outlet surfaces adapted to or matching the external contours of the impression cylinder are disposed over the entire length of a blowing-air finger carrying tube, and extend down into a cylinder nip. By means of an adjusting device, the blowing-air fingers can be changed over from a working position for first-form or recto printing to a working position for first-form and perfector or recto-and-verso printing. A disadvantage resulting from this heretofore known device is that the smoothing action by the air-outlet surfaces takes place simultaneously across the entire width of the sheet. Although this, in fact, ensures a local contact of the sheets below the air-outlet surfaces, it is possible that air pockets extending annularly below the sheet may remain and may not be able to be smoothed out. Consequently, the air underneath the sheets may not be able to be squeezed out until it is in the printing nip, which may have a detrimental effect upon the quality of the printed products.

The published German Patent Document 39 20 730 C2 discloses a device for smoothing a sheet on an impression cylinder in a sheet-fed rotary printing press. Mounted parallel to the axis of the impression cylinder is a blowing-air nozzle which, being connectible to a drive, reciprocates or oscillates forwards and backwards in the transport direction of the printed sheet in time with the working cycle of the printing press. A disadvantage associated with this heretofore known device is that a high operational outlay or expense is required for the oscillating drive.

Proceeding from the prior art described hereinbefore, it is an object of the invention is to provide a device for achieving a flat or flush contact between stocks or printed materials and which ensures that sheets which are to be printed are applied crease-free to curved surfaces of cylinders in order to improve the printing quality.

With the foregoing and other objects in view, there is provided, in accordance with the invention, a device for achieving a flat contact of stock on a curved surface of a cylinder for transporting the stock into a printing nip, comprising a plurality of blowing-air bars disposed in a region between an impression cylinder and a transfer drum and upstream of the printing nip in transport direction of the stock, the blowing-air bars being directed for blowing air in a direction opposing the transport direction of the stock, at least one of the plurality of blowing-air bars being stationary and, with the other of the plurality of blowing-air bars, respectively, having a plurality of air-blowing nozzle-shaped outlets disposed in a substantially arrow-shaped arrangement on the respective circumferences thereof, the arrangement of outlets including a central outlet disposed farthest upstream of the arrangement of outlets in the transport direction so as to be a first one of the outlets to act upon a sheet being transported in the transport direction.

An advantage attainable with the foregoing construction is that, as a printed sheet moves past the blowing-air bars, the printed sheet, starting from the center thereof and moving towards the leading and trailing edges thereof, experiences successive smoothing in a direction opposite to the transport direction thereof. The application of blown air in continuous succession reliably irons out creases and wrinkles, especially in the case of very thin stock, with the result that a sheet conveyed on the surface of the impression cylinder is in full contact with the surface, and any remaining air pockets or creases are pressed out before the sheet reaches the printing nip. The use of the device according to the invention permits mackling-free printing and high stability of the printing quality during a production run.

In accordance with another feature of the invention, starting from the central outlet and extending towards the ends of the respective blowing-air bars, respective pairs of the outlets, of which each outlet of a respective pair thereof is located on opposite sides of the central outlet, are formed with outlet openings having cross sections which increase towards the ends of the blowing-air bar. This advantageously aids in the smoothing action in the outer regions of the sheets.

In accordance with a further feature of the invention, the central nozzle-shaped outlet and the pair of nozzle-shaped outlets located closest to the ends of the blowing-air bar enclose an angle $\beta$ therebetween. This permits an extension of a linear operating range to a zonal smoothing sector which extends over a circumferential region of the impression cylinder.

In accordance with an added feature of the invention, means are provided for feeding blowing air to the blowing-air bars independently of one another. Specific individual requirements are thereby able to be met in the processing of an extremely wide range of different grades of stock with the economical application of blowing air.

Moreover, in accordance with an additional feature of the invention, at least one of the other blowing-air bars is adjustable, and adjusting means are included for varying the working position of the respective blowing-air bar in accordance with the grade of stock to be processed.

In accordance with yet another feature of the invention, at least one of the other blowing-air bars is adjustable, and remotely controllable means are included for swivelling the adjustable blowing-air bar through an angle of incidence $\alpha_1$ with respect to a perpendicular to ground, as part of a job-specific presetting for processing cardboard.

In accordance with yet a further feature of the invention, the adjustable blowing-air bar is swivellable by the remotely controllable means through an angle of incidence $\alpha_2$ with respect to the perpendicular, which differs from the angle of incidence $\alpha_1$, as part of a job-specific presetting for processing paper or thin printing materials.

Stock-specific requirements are thus permitted to be dealt with in the application of blowing air to the sheets, with a further requirement also being fulfilled in that a stiff cardboard sheet of low pliability is able to be guided free of smearing.

In accordance with yet an added feature of the invention, the other of the plurality of blowing-air bars include two stationary blowing-air bars fixed to the printing press in association with the impression cylinder and being selectively feedable with blowing air in accordance with the grade of stock to be processed. Consequently, an embodiment without an adjusting mechanism is possible. As part of the presetting process, and depending upon the grade of stock to be processed, the blowing-air bar which is to be fed with or subjected to blowing air is connected to a blowing-air source.

It should also be noted, in accordance with a concomitant feature of the invention, one of the two blowing-air bars fixed to the printing press is set at an angle of incidence $\alpha_2$ with respect to a perpendicular to ground, and the other of the two blowing-air bars is set at an angle of incidence $\alpha_1$ with respect to the perpendicular, which is smaller than the angle of incidence $\alpha_2$.

Other features which are considered as characteristic for the invention are set forth in the appended claims.

Although the invention is illustrated and described herein as embodied in a device for achieving a flat contact of stocks or printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
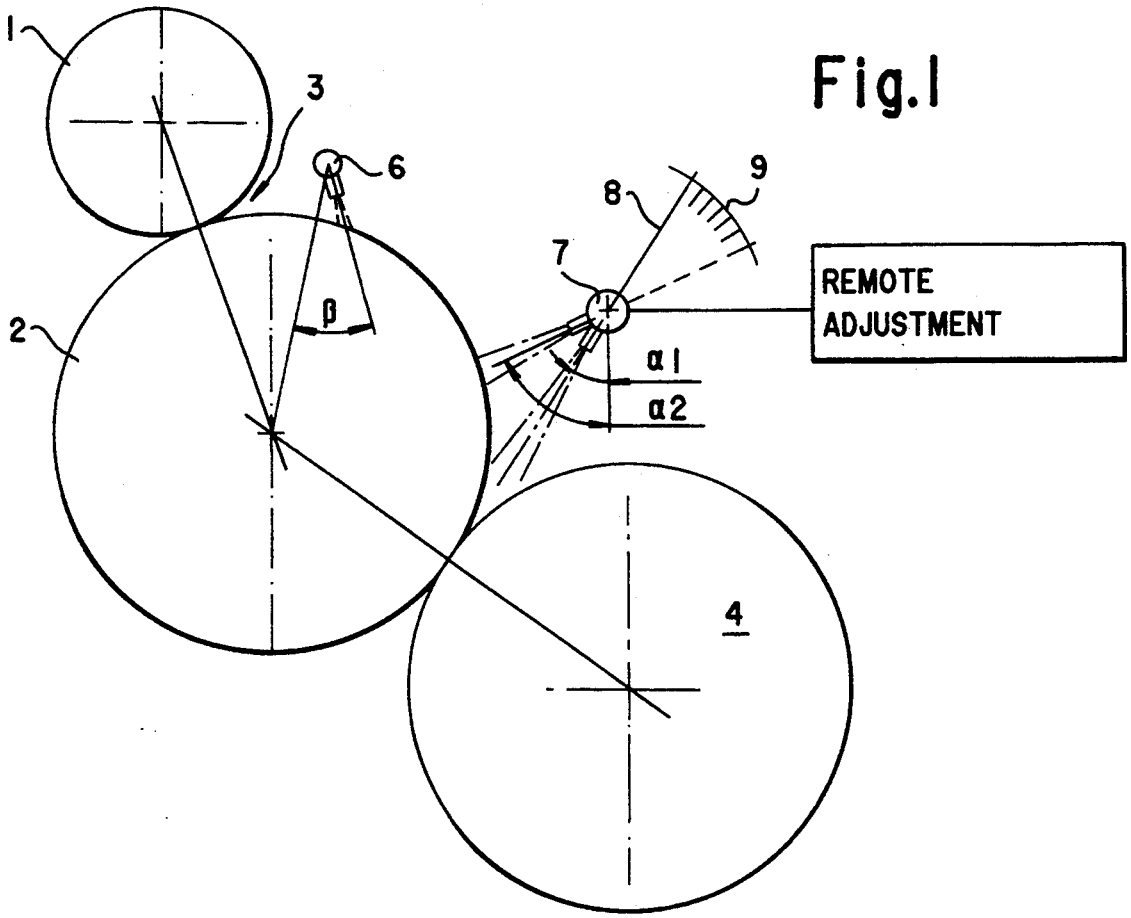
FIG. 1 is a diagrammatic side elevational view of an impression cylinder and transfer drums assembled with an adjustable blowing-air bar forming part of the invention of the instant application.
Figure 3:
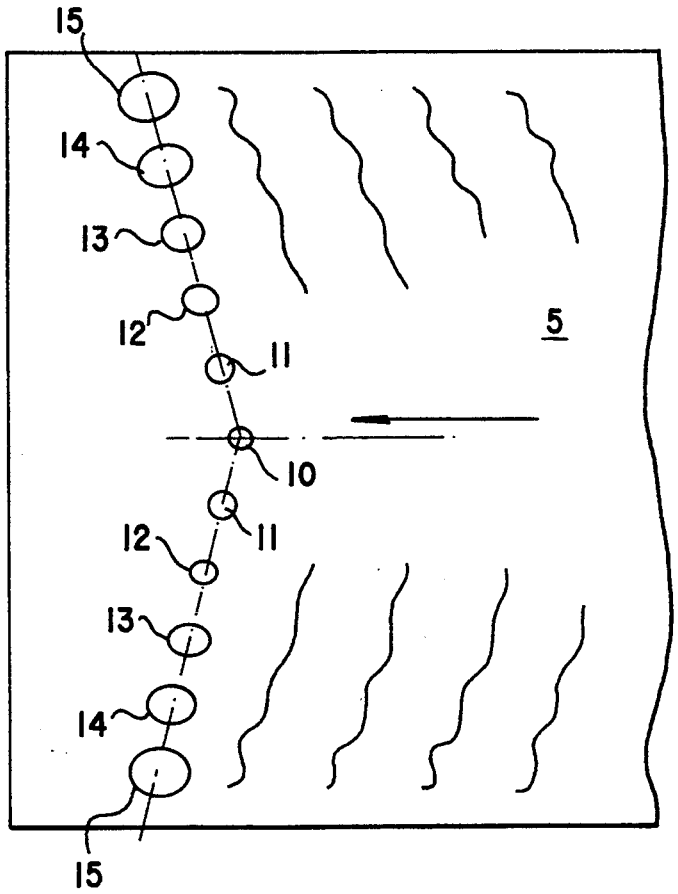
Figure 4:
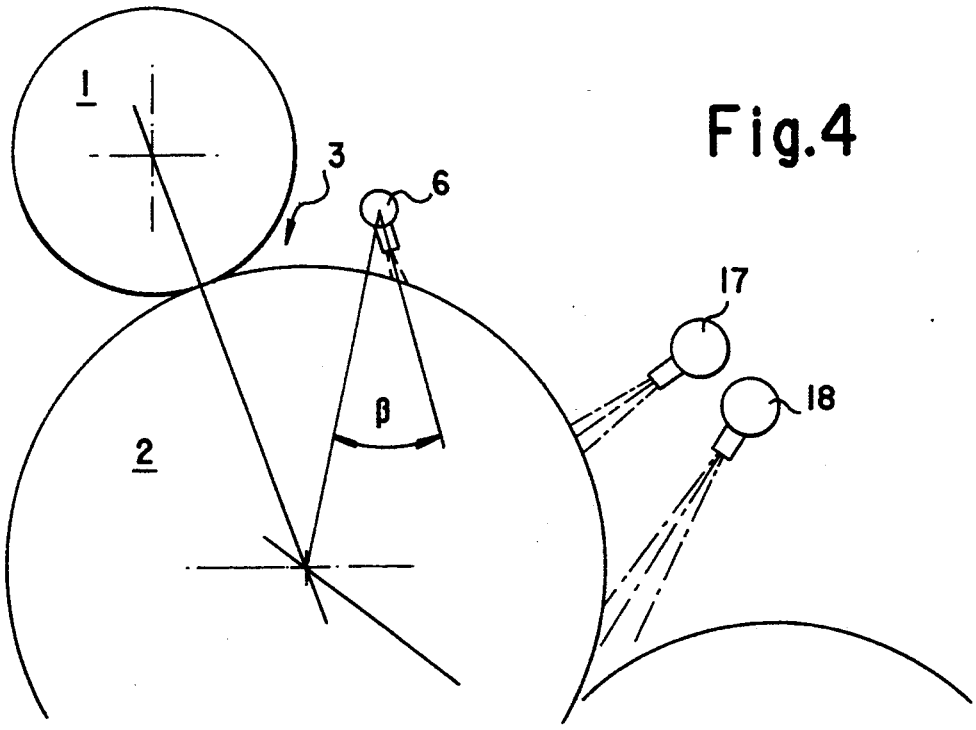

FIG. 3 is a fragmentary top plan view of a sheet with outlet openings shown diagrammatically thereabove; and FIG. 4 is a view similar to that of FIG. 1, except that the adjustable blowing-air bar in the embodiment of FIG. 1 is replaced by an arrangement of two stationary blowing-air bars inclined at respective angles of incidence $\alpha_1$ and $\alpha_2$ between the impression cylinder and one of the transfer drums in the embodiment of FIG. 4.

Referring now to the drawings and, first, particularly to FIG. 1 thereof, there is shown therein an impression cylinder 2 and transfer drums or cylinders 1 and 4, assembled with an adjustably disposed blowing-air bar 7. A printing nip 3 is formed between the transfer cylinder 1 and the impression cylinder 2, and a sheet 5 (FIG. 2) is printed over the length thereof in the printing nip 3. The sheet 5 is transferred from the so-called double-size transfer drum 4, i.e., having twice the diameter of the so-called single-size transfer cylinder 1, for example, to the likewise double-size impression cylinder 2, and is conveyed therefrom into the printing nip 3. Rotatably mounted between the impression cylinder 2 and the transfer drum 4 is an adjustable blowing-air bar 7 disposed on a perpendicular to an imaginary line connecting the axes of rotation of the impression cylinder 2 and the transfer drum 4. The adjusting movement of the blowing-air bar 7 may be effected by a lever of an adjusting device 8, the current position and the adjusted distance being readable from a scale 9.

Figure 2:
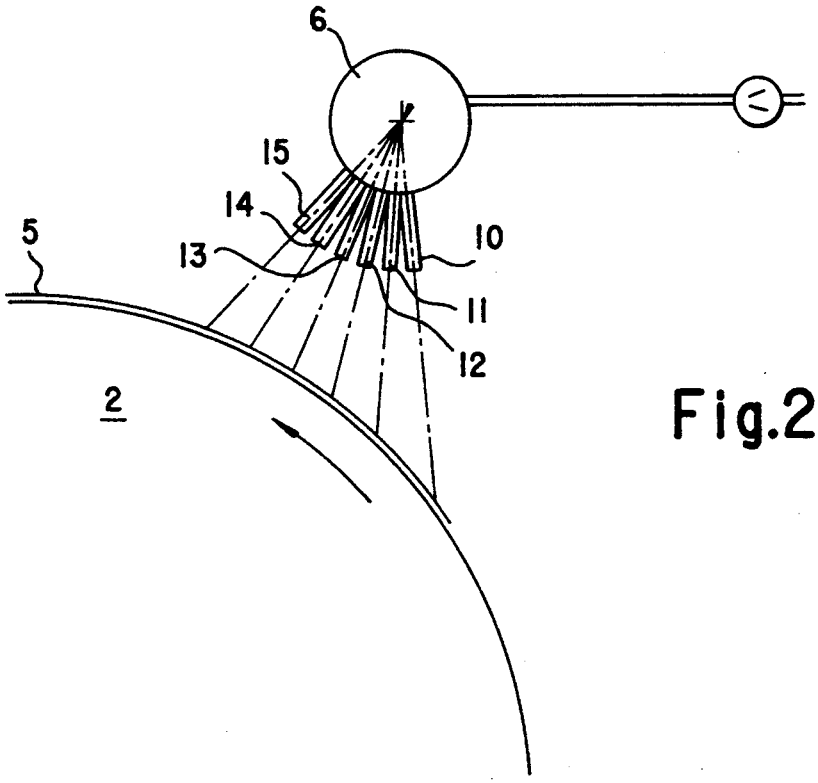
FIG. 2 is an enlarged fragmentary view of FIG. 1 showing another embodiment of the invention having a stationary blowing-air bar with an arrow-shaped arrangement of the outlet openings thereof.

A stationary blowing-air bar 6 is mounted above the adjustable blowing-air bar 7 at the circumference of the impression cylinder 2 upstream of the printing nip 3, as viewed in the travel or transport direction of the sheet 5 (FIG. 2). The outlet openings of the stationary blowing-air bar 6 are directed opposite to the transport direction of the sheets 5. The angle represents the region on the circumference of the impression cylinder 2 which can be covered by the blowing air from the outlet openings.

As part of the presetting process when a change in the printing job takes place, it is possible to enter, at the central control desk of the printing press, the particular type of stock or printing material on which the following job is to be printed. Depending upon the stock, the blowing-air bar 7, operated by electric motor via the adjusting device 8, moves into a defined working position.

If thick paper or cardboard sheets are being processed, the adjustable blowing-air bar 7 is swivelled through the angle of incidence $\alpha_1$ with respect to the perpendicular. In this working position, the air blowing from the outlet openings of the blowing-air bar 7 acts upon the rear or trailing end of the sheet 5, holding that end down and thus permitting a smear-free transport of the sheets. Conversely, if thin grades of stock are to be processed, the electromotively driven blowing-air bar 7 is swivelled through an angle of incidence $\alpha_2$ with respect to the perpendicular. The escaping blowing-air is then directed towards the surface of the impression cylinder 2 and not towards the cylinder nip formed between the impression cylinder 2 and the transfer drum 4. Irrespective of whether the adjustable blowing-air bar 7 assumes its working positions represented by the angles of incidence $\alpha_1$ and $\alpha_2$, the transported sheet 5, whether of paper or of cardboard, is smoothed by the blowing-air bar 6 before it enters the printing nip 3. Due to the orientation of the blowing-air bar 6 in a direction opposite to the transport direction of the sheets 5, a pulling effect is exerted on the sheets 5 which are to be conveyed. Any air pockets remaining between the outer cylindrical surface of the impression cylinder 2 and the underside of the sheet 5 are squeezed out at the sides, so that when the sheet 5 passes the printing nip 3, no relative movement between the sheet 5 and the surface of the impression cylinder 2 occurs.

FIG. 2 is a side view of a stationary blowing-air bar 6, with an arrow-shaped arrangement of the air-outlet openings thereof.

Situated on the circumference of the impression cylinder 2 is a sheet 5, the trailing end of which, as shown in a slightly exaggerated form in FIG. 2, is fluttering. Mounted above the sheet 5 is the stationary blowing-air bar 6, on which there are mounted, starting from a central outlet opening 10, pairs of outlet openings 11, 12, 13, 14 and 15. The phantom or dot-dash lines indicate approximately the axes of the open or free jets which escape from the outlet openings and form the angle $\beta$. The open jets escaping from the outlet openings spread out fan-like and cover a region of the circumference of the impression cylinder 2 together with the sheet 5 transported thereon. The outlet openings 10, 11, 12, 13, 14 and 15 for the blowing air are in the form of nozzles and permit the direction of the air jets to be specifically targeted. The blowing air is brought as close as possible to the surface of the sheet 5, thereby assuring that the loss of the open jets to diffusion is kept very low.

FIG. 3 is a top plan view of a sheet with outlet openings for blowing air located thereabove. As can be seen from this figure of the drawings, the pairs of outlet openings 10, 11, 12, 13, 14 and 15 are disposed in a more-or-less arrow-shaped arrangement on the blowing-air bars 6 and 7.

Conveyed in the transport direction, the sheet 5 initially enters the operating range of the outlet opening 10, which represents the idealized tip of an arrow. Due to the air blown through the outlet opening 10, the transported sheet 5 is pressed first at its center against the surface of the impression cylinder 2 before air blown from the outlet-opening pair 11, positioned slightly downstream from the central outlet opening 10, acts upon the sheet 5. As it passes the blowing-air bars 6 and 7, the sheet 5 consequently undergoes a smoothing process directed from the center to the outer edges and causing a flat or flush contact of or between the sheets 5 on the circumference of the impression cylinder 2. Because the smoothing of the sheet 5 takes place successively from the inside to the outside, the uniform contact of the sheet 5 across its width on the circumference of the impression cylinder 2 is assured. Local air pockets are thus pressed out either to the sides or towards the rear or trailing edge of the sheet. The arrangement of the pairs of outlet openings 10, 11, 12, 13, 14 and 15 on the blowing-air bars 6 and 7 may also be in sheet form without thereby deviating from the concept upon which the invention is based. What is important is that the blowing-air should act successively, starting from the center of the sheet and progressing up to the side edges. The cross sections of the pairs of air-outlet openings 11, 12, 13, 14 and 15 may be such that, starting from the central outlet opening 10, they gradually increase towards the outside. It is thereby possible to reduce the number of nozzle-shaped outlet-opening pairs 11, 12, 13, 14 and 15. Moreover, an enlargement of the cross sections of the outlet openings increases the region of the sheet 5 on which the blown air acts.

FIG. 4 shows an embodiment of the device according to the invention wherein two stationary blowing-air bars 17 and 18, inclined at angles of incidence $\alpha_1$ and $\alpha_2$, are disposed between the impression cylinder 2 and the transfer drum 4.

In this arrangement, the staionary blowing-air bar 17 is installed so that it is inclined at the angle $\alpha_1$ for the processing of paper, while the stationary blowing-air bar 18 is installed so that it is inclined at the angle $\alpha_1$ for the processing of cardboard. Depending upon the grade of stock to be processed, either the blowing-air bar 17 or the blowing-air bar 18 is connected to the blowing-air supply of the printing press. This embodiment dispenses with the need for an adjusting device 8 of the type shown in FIG. 1. It is believed to be readily apparent that the outlet openings 10, as well as the pairs of outlet openings 11, 12, 13, 14 and 15, are disposed in a more-or-less arrow-shaped arrangement on the two stationary blowing-air bars 17 and 18. Disposed above the impression cylinder 2 is the blowing-air bar 6, the air-outlet openings 10, 11, 12, 13, 14 and 15 of which are disposed in staggered relationship in the circumferential region identified by the angle $\beta$. Reference should be made to the fact that, in the embodiment with the blowing-air bar 6 and the adjustable blowing-air bar 7 or in the embodiment with the blowing-air bar 6 and the two stationary blowing-air bars 17 and 18, the application of the blowing air can be specifically adapted to suit respective individual requirements. Thus, for example, it is possible for only the blowing-air bar 6 or only the blowing-air bar 7 to be supplied with blowing air, and for the volumetric flow or flow rate of the blowing air escaping from the outlet openings 10, 11, 12, 13, 14 and 15 also to be variable. Temperature control of the blowing air in order to improve intermediate drying as the sheets 5 are transported from printing unit to printing unit is likewise conceivable.

In the interest of being as complete as possible, it should also be noted that the adjustment of the blowing-air bar 7 may also be performed manually at the adjusting device 8. It is then possible, at the scale 9, to read off the currently set operating position of the blowing-air bar 7.

I claim:

1. Device for achieving a flat contact of stock on a curved surface of a cylinder for transporting the stock into a printing nip, comprising a plurality of blowing-air bars disposed in a region between an impression cylinder and a transfer drum and upstream of the printing nip in transport direction of the stock, said blowing-air bars being directed for blowing air in a direction opposing the transport direction of the stock, at least one of said plurality of blowing-air bars being stationary and at least one of said plurality of blowing-air bars being adjustable, said blowing-air bars each having a plurality of air-blowing nozzle-shaped outlets formed in a substantially arrow-shaped arrangement on the respective circumferences thereof, said arrangement of outlets including a central outlet disposed farthest upstream of said arrangement of outlets in the transport direction so as to be a first one of said outlets to act upon a sheet being transported in the transport direction, and adjusting means for varying a working position of said adjustable blowing-air bar between predetermined working positions depending on a grade of stock to be processed; wherein, starting from said central outlet and extending towards the ends of the respective blowing-air bars, respective pairs of said outlets, of which each outlet of a respective pair thereof is located on opposite sides of said central outlet, are formed with outlet openings having cross sections which increase towards said ends of said blowing-air bar.

2. Device according to claim 1, wherein said central nozzle-shaped outlet and the pair of nozzle-shaped outlets located closest to said ends of said blowing-air bar enclose an angle $\beta$ therebetween.

3. Device according to claim 1, including means for feeding blowing air to said blowing-air bars independently of one another.

4. Device according to claim 1, wherein said adjusting means include remotely controllable means for swivelling said adjustable blowing-air bar through an angle of incidence $\alpha_1$ with respect to a perpendicular to ground, as part of a job-specific presetting for processing cardboard.

5. Device according to claim 4, wherein said adjustable blowing-air bar is swivellable by said remotely controllable means through an angle of incidence $\alpha_2$ with respect to said perpendicular which differs from said angle of incidence $\alpha_1$, as part of a job-specific presetting for processing paper.

6. Device according to claim 1, wherein said plurality of blowing-air bars include two stationary blowing-air bars fixed to the printing press in association with the impression cylinder and being selectively feedable with blowing air in accordance with the grade of stock to be processed.

7. Device according to claim 6, wherein one of said two blowing-air bars fixed to the printing press is set at an angle of incidence $\alpha_2$ with respect to a perpendicular to ground, and the other of said two blowing-air bars is set at an angle of incidence $\alpha_1$ with respect to said perpendicular which is smaller than said angle of incidence $\alpha_2$.

8. Device according to claim 1, wherein said adjusting means are means for adjusting said blowing-air bar to one of the working positions prior to processing a given grade of stock and retaining said blowing-air bar at the respective working position during processing of the given grade of stock.

* * * * *